United States Patent [19]

Kund

[11] 4,291,934

[45] Sep. 29, 1981

[54] CRIMP TYPE CABLE SHIELD BONDING DEVICE

[75] Inventor: August Kund, Glendale, Calif.

[73] Assignee: Communications Technology Corp., Los Angeles, Calif.

[21] Appl. No.: 125,586

[22] Filed: Feb. 28, 1980

[51] Int. Cl.[3] ..... H01R 11/20

[52] U.S. Cl. ..... 339/95 R; 339/276 R

[58] Field of Search ..... 339/14 R, 95 R, 97 R, 339/97 C, 276 R; 174/84 S, 88 R, 88 S, 78

[56] References Cited

U.S. PATENT DOCUMENTS

| | | | |
|---|---|---|---|
| 3,715,705 | 2/1973 | Kuo | 174/84 C X |
| 3,777,049 | 12/1973 | Gillemot et al. | 174/78 |
| 3,831,132 | 8/1974 | Bowden et al. | 339/95 R |
| 4,026,619 | 5/1977 | Gillemot | 339/95 R X |

*Primary Examiner*—Eugene F. Desmond

[57] ABSTRACT

A crimp type cable shield bonding device for electrical connection to the shield of a sheathed and shielded cable having an outer insulating sheath and an underlying conducting shield which encloses a bundle of conductors. A U-shaped clip having opposed wings and a fastener for holding the wings together when crimped on the cable sheath and shield. A spring plate positioned between said wings overlying one of the wings and having a section bowed outward toward the other of the wings to provide a spring pressure engagement with the shield when the cable sheath and shield are crimped therein. A terminal on the spring plate positioned within a terminal on the clip for attaching to a ground conductor or the like. An integral tab carried on the clip for holding the clip in the crimped position.

7 Claims, 6 Drawing Figures

CRIMP TYPE CABLE SHIELD BONDING DEVICE

BACKGROUND OF THE INVENTION

This invention relates to cable shield bonding devices which provide for making an electrical connection, usually a ground connection, to the electrically conducting shield of a cable.

A typical cable includes a bundle of insulated conductors enclosed within an electrical conducting shield which in turn is covered by an electrical insulating protective sheath.

At the end of a cable where the conductors are terminated at a terminal board or are spliced to the conductors of another cable or otherwise, continuity needs to be provided for the shield, as by connecting to the shield of another cable or to ground or otherwise as desired.

A variety of configurations have been provided for making connections to the shield of a cable. Two such devices are shown in U.S. Pat. Nos. 3,915,540 and 3,963,299. A crimp type cable shield bonding device is shown in the co-pending application of Mangrobang et al., Ser. No. 066,780, filed Aug. 14, 1979 and assigned to the same assignee as the present application. Another crimp type bonding device presently in use has a first relatively thick U-shaped clip with a second relatively thin U-shaped clip riveted therein. The inner clip has inwardly directed teeth at the outer edges thereof. The device is utilized by placing the cable sheath and shield within the clips and then compressing or crimping the outer clip together to clamp the cable sheath and shield therein.

The crimp type bonding device is less expensive and easier to use than the earlier bolted type devices. However there are certain disadvantages with the existing crimp type devices. The clamping force is achieved by the bending of the outer clip and in order to be assured of maintaining the clamping force, the outer clip must be made of relatively heavy material, hence increasing its cost. Also, the outer clip sometimes tends to relax its clamping force, thereby creating possiblities of poor ground connection. Also, since the outer protective sheath is formed of plastic or other electrical insulating material which tends to exhibit cold flow, an initially tight electrical connection formed during the crimping operation sometimes tends to loosen with the flow of the plastic resulting in a poor or inadequate ground.

It is an object of the present invention to provide a new and improved crimp type cable shield bonding device which is inexpensive and easy to manufacture and install. A further object is to provide such a bonding device which can be permanently attached in the clamping position. Another object is to provide a bonding device incorporating a spring member which will continue to exert a shield engaging force after crimping in place and after cold flow of the insulating sheath. An additional object is to provide such a bonding device with terminals for the outer clip and inner spring plate which are attached at a single point to the ground or other conductor.

Other objects, advantages, features and results will more fully appear in the course of the following description.

SUMMARY OF THE INVENTION

A crimp type cable shield bonding device for electrical connection to the shield of a sheathed and shielded cable having an outer insulating sheath and an underlying conducting shield which enclose a bundle of conductors. A U-shaped clip having opposed wings and a fastener for holding the wings together, and a spring plate overlying one of the wings and having a section bowed outward toward the other of the wings, with the clip and plate adapted for receiving the cable sheath and shield between the plate and the other wing, with the plate being compressed when the wings are brought together, with the fastener holding the wings together. A terminal for the clip, typically U-shaped, and a terminal for the plate lying within the clip terminal, providing for crimping both terminals to a conductor.

DESCRIPTION OF THE PREFERRED EMBODIMENTS

Figure 3:
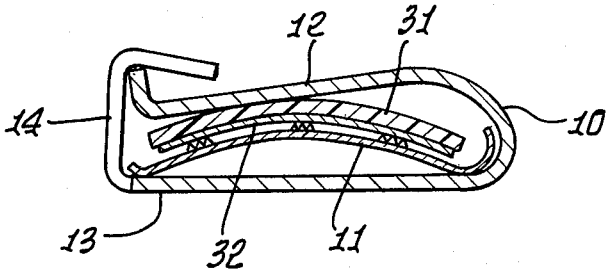
FIGS. 3 and 4 are sectional views taken along the lines 3—3 and 4—4 respectively of FIG. 2.
Figure 4:
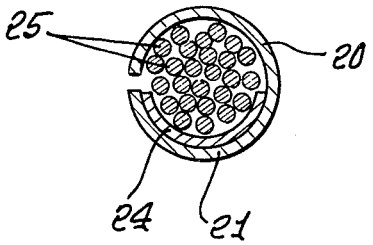
Figure 5:
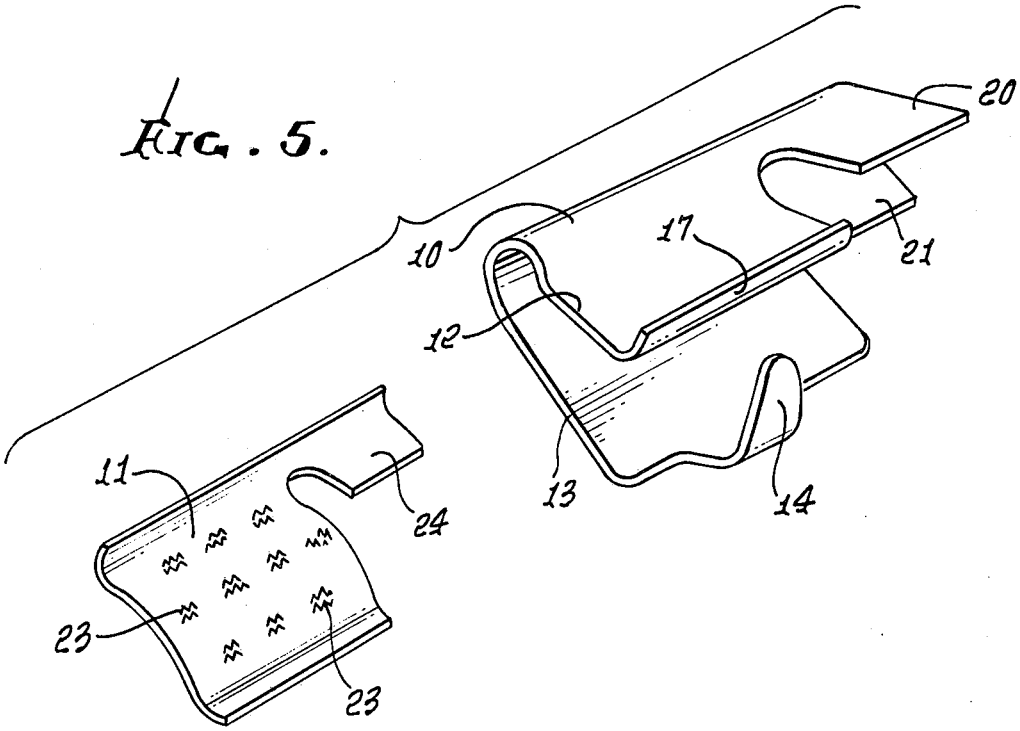
FIG. 5 is an exploded view of the bonding device of FIG. 1.

The bonding device as shown in FIGS. 1–5 includes a U-shaped clip 10 and a spring plate 11. The clip 10 has wings 12, 13, and in the embodiment illustrated, a fastener in the form of a tab 14 is formed integral with the wing 13. Also, preferably the outer edge 17 of the wing 12 is bent outwardly for engagement by the tab 14, as shown in FIG. 3.

The clip 10 preferably includes means for attachment to a ground conductor or the like and this terminal preferably is U-shaped with arms 20, 21. The clip typically is made of steel or brass and normally would be tin plated or solder dipped.

The spring plate 11 is made of a resilient material such as spring brass or phosphor bronze or the like. The plate 11 is adapted for overlying the wing 13 of the clip 10 and is bowed upward, usually in the center section, and a preferred cross-section for the spring plate is shown in FIG. 3. The plate preferably has a plurality of points 23 which project outwardly from the bowed section for making improved electrical contact with the cable shield. The plate also includes a terminal portion 24 adapted for overlying the arm 21 of the terminal of the clip 10.

Figure 1:
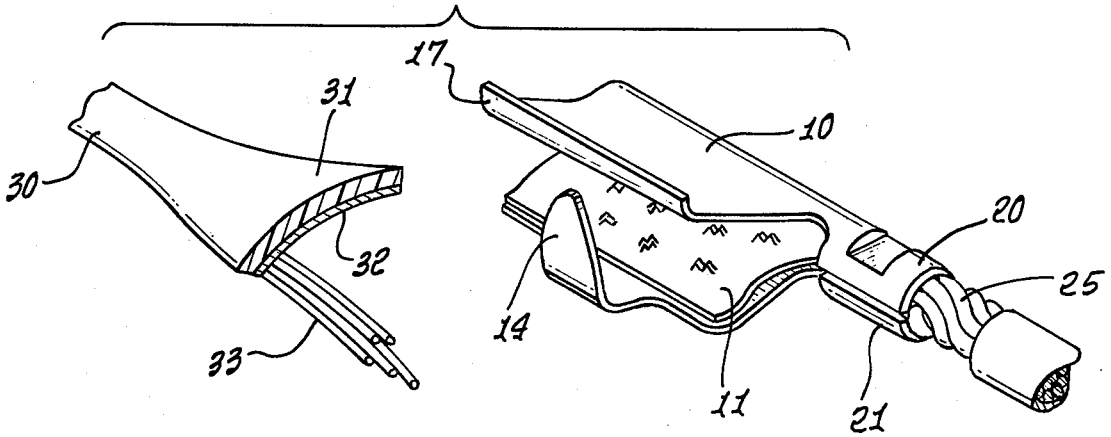
FIG. 1 is a perspective view of a crimp type cable shield bonding device showing the device in the open position ready to receive the cable sheath and shield, and incorporating the presently preferred embodiment of the invention.
Figure 2:
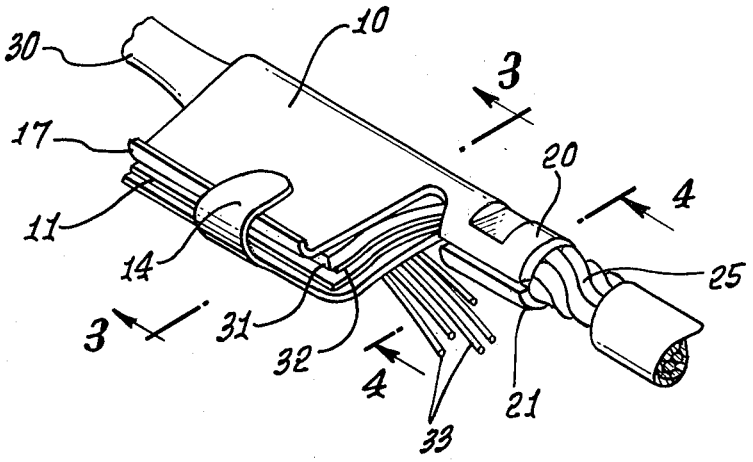
FIG. 2 is a view similar to that of FIG. 1 showing the bonding device crimped on the cable sheath and shield.

The spring plate 11 is assembled within the clip 10, as shown in FIG. 1. The next step in use usually is attachment of a conductor, such as the conductor 25 to the clip and plate. This is carried out by placing the conductor between the arms 20, 21 of the clip and then crimping the arms about the conductor using a conventional crimping plier.

The cable 30 which is to be bonded, is prepared by slitting the sheath 31 and shield 32 a short distance freeing the cable conductors 33. The slit portion of the sheath and shield is flattened, as shown in FIG. 1 and is positioned between the wings of the clip, with the shield resting on the spring plate. The wings of the clip are then crimped together, as by using a pair of pliers, and the tab 14 is bent over the edge 17, also by using a pair of pliers.

The clip 10 provides a firm mechanical connection to the cable sheath and shield. The spring plate 11 provides a good electrical connection with the cable shield. When the clip is crimped, the spring plate is compressed. Then if this mechanical pressure on the sheath causes cold flow of the sheath material with a normal loosening of the mechanical clamping, the spring plate compensates for such cold flow and maintains the good electrical contact with the shield.

Figure 6:
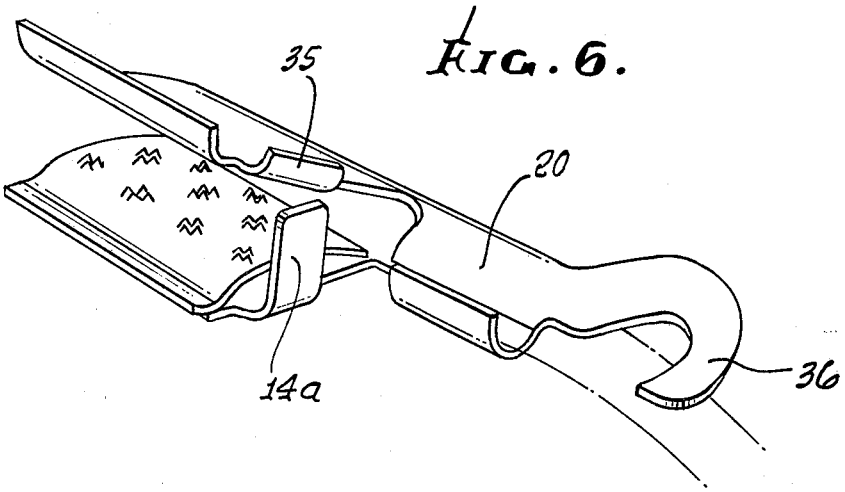
FIG. 6 is a perspective view of a bonding device incorporating alternative embodiments of the invention.

If desired, a U-shaped spring plate with opposed wings could be utilized, but it appears that the single wing plate configuration will be satisfactory. Also, the points on the spring plate could be omitted but they are preferred for enhancing the electrical connection. Some other variations in construction are shown in FIG. 6, where elements corresponding to those of FIGS. 1–5 are identified by the same reference numerals. In the embodiment of FIG. 6, a tab 14*a* is provided at the end of the wing 13 rather than along the outer edge. A portion 35 of the wing 12 may be turned outwardly for engagement by the tab 14*a*. A hook type terminal 36 may be formed as a portion of the arm 20 of the clip, suitable for fastening with a screw or the like.

Although exemplary embodiments of the invention have been disclosed for purposes of illustration, it will be understood that various minor changes, modifications and substitutions may be incorporated in such embodiment without departing from the invention as hereinafter claimed.

I claim:

1. In a crimp type cable shield bonding device for electrical connection to the shield of a sheathed and shielded cable having an outer insulating sheath and an underlying conducting shield which enclose a bundle of conductors, the combination of:

a U-shaped clip having opposed wings and including integral fastener means for holding said wings together, and terminal means having opposed arms for receiving and clamping a conductor therebetween; and a spring plate separate from said clip and overlying one of said wings and having a section bowed outward toward the other of said wings;

with said clip and plate adapted for receiving said sheath and shield between said plate and said other wing, with said plate being compressed when said wings are brought together with said sheath and shield therebetween, so that said compressed spring plate exerts contact pressure on said shield, and with said fastener means holding said wings together and holding said plate between said wings.

2. A device as defined in claim 1 wherein said plate includes a plurality of points projecting upward towards said other wing for engaging the cable shield.

3. In a crimp type cable shield bonding device for electrical connection to the shield of a sheathed and shielded cable having an outer insulating sheath and an underlying conducting shield which enclose a bundle of conductors, the combination of a U-shaped clip having opposed wings and including first terminal means for attaching a conductor thereto; and a spring plate overlying one of said wings and having a section bowed outward toward the other of said wings and including second terminal means for attaching a conductor thereto, with said second terminal means disposed within said first terminal means;

with said clip and plate adapted for receiving said sheath and shield between said plate and said other wing, with said plate being compressed when said wings are brought together with said sheath and shield therebetween.

4. In a crimp type cable shield bonding device for electrical connection to the shield of a sheathed and shielded cable having an outer insulating sheath and an underlying conducting shield which enclose a bundle of conductors, the combination of:

a U-shaped clip having opposed wings and including fastener means for holding said wings together and first terminal means for attaching a conductor thereto; and a spring plate overlying one of said wings and having a section bowed outward toward the other of said wings and second terminal means for attaching a conductor thereto;

with said clip and plate adapted for receiving said sheath and shield between said plate and said other wing, with said plate being compressed when said wings are brought together with said sheath and shield therebetween with said fastener means holding said wings together.

5. A device as defined in claim 4 wherein said first terminal means includes first and second opposed arms and said second terminal means includes a third arm overlying one of said first and second arms.

6. In a crimp type cable shield bonding device for electrical connection to the shield of a sheathed and shielded cable having an outer insulating sheath and an underlying conducting shield which enclose a bundle of conductors the combination of:

a U-shaped clip having opposed wings and including fastener means for holding said wings together; and a spring plate overlying one of said wings and having a section bowed outward toward the other of said wings;

with said clip and plate adapted for receiving said sheath and shield between said plate and said other wing, with said plate being compressed when said wings are brought together with said sheath and shield therebetween, with said fastener means holding said wings together; and with said fastener means including an integral tab projecting from the outer edge of one of said wings and adapted for folding over the outer edge of the other of said wings, and an outwardly turned outer edge on said other wing for engagement with said tab.

7. In a crimp type cable shield bonding device for electrical connection to the shield of a sheathed and shielded cable having an outer insulating sheath and an underlying conducting shield which enclose a bundle of conductors, the combination of:

a U-shaped clip having opposed wings and including fastener means for holding said wings together; and a spring plate overlying one of said wings and having a section bowed outward toward the other of said wings;

with said clip and plate adapted for receiving said sheath and shield between said plate and said other wing, with said plate being compressed when said wings are brought together with said sheath and shield therebetween, with said fastener means holding said wings together; and with said fastener means including an integral rib protecting from an end of one of said wings and adapted for folding over the corresponding end of the other of said wings, and an outwardly turned edge on said corresponding end of said other wing for engagement with said tab.

* * * * *